United States Patent [19]

Schellenberg et al.

[11] Patent Number: 4,770,469

[45] Date of Patent: Sep. 13, 1988

[54] PROCESS FOR CONTROLLING THE MOVEMENT OF A UNIVERSALLY SWIVELLABLE CUTTING ARM OF A PARTIAL CUT CUTTING MACHINE AS WELL AS APPARATUS FOR PERFORMING THIS PROCESS

[75] Inventors: Eduard Schellenberg, Linz; Gerhard Steinbrucker; Herwig Wrulich, both of Zeltweg; Reinhard Neuper, Judenburg; Alfred Zitz, Zeltweg, all of Austria

[73] Assignee: Voest-Alpine Aktiengesselschaft, Linz, Austria

[21] Appl. No.: 926,172

[22] Filed: Nov. 3, 1986

[30] Foreign Application Priority Data

Nov. 4, 1985 [AT] Austria ..... 3171/85

[51] Int. Cl.[4] ..... E21C 35/24

[52] U.S. Cl. ..... 299/1; 299/75

[58] Field of Search ..... 299/1, 72, 73, 75, 76

[56] References Cited

U.S. PATENT DOCUMENTS

| | | | |
|---|---|---|---|
| 4,111,488 | 9/1978 | Sigott et al. | 299/75 X |
| 4,343,515 | 8/1982 | Higgs et al. | 299/75 |
| 4,591,209 | 5/1986 | Dröscher et al. | 299/1 |
| 4,641,889 | 2/1987 | Brandl | 299/75 |
| 4,721,340 | 1/1988 | Wrulich et al. | 299/1 |

FOREIGN PATENT DOCUMENTS

| | | | |
|---|---|---|---|
| 2622738 | 12/1977 | Fed. Rep. of Germany | 299/1 |
| 2068039 | 8/1981 | United Kingdom | 299/1 |
| 568720 | 12/1977 | U.S.S.R. | 299/1 |

*Primary Examiner*—Stephen J. Novosad
*Assistant Examiner*—David J. Bagnell
*Attorney, Agent, or Firm*—Cushman, Darby & Cushman

[57] ABSTRACT

A method and apparatus for controlling the movement of a universally swivellable cutting arm of a partial cut cutting machine of the kind including a first hydraulic drive for lifting and lowering the cutting arm in order to preselect the depth of cut and a further hydraulic drive for swivelling the cutting arm transversely relative to the direction of lifting movement and lowering movement, wherein the time interval elapsed for actuating one of the drives and/or the volumetric amount of pressurized fluid supplied to each of the drives is measured and wherein, in dependence on the desired preselected depth of cut and after having attained the time interval of actuating one drive required for the preselected depth of cut or after having attained the volumetric amount for the displacement in direction of the preselected depth of cut, supply of pressurized fluid to the first drive is closed and only the supply of pressurized fluid to the further drive is released.

13 Claims, 4 Drawing Sheets

PROCESS FOR CONTROLLING THE MOVEMENT OF A UNIVERSALLY SWIVELLABLE CUTTING ARM OF A PARTIAL CUT CUTTING MACHINE AS WELL AS APPARATUS FOR PERFORMING THIS PROCESS

BACKGROUND OF THE INVENTION

1. Field of the Invention

The invention refers to a process for controlling the movement of a universally swivellable cutting arm of a partial cut cutting machine comprising a first hydraulic drive means for lifting and lowering the cutting arm and a further hydraulic drive means for swivelling the cutting arm transversally relative to the direction of lifting movement and lowering movement, as well as to an apparatus for performing this process.

2. Description of the Prior Art

Partial cut cutting machines equipped with a universally swivellable cutting arm comprise in most cases hydraulic cylinder-piston-aggregates for lifting and lowering the cutting arm in essential vertical direction as well as a swivel drive, which may, for example, be effected by a hydraulically actuated tooth rack meshing with the toothed wheel of a traversing gear. Swivelling of the cutting arm is, as a rule, effected around an axis extending substantially normal to the plane of the chassis, noting that there are swivelled together with the traversing gear around this substantially vertical axis also the hydraulic cylinder-piston-aggregates provided for lifting and lowering the cutting arm. The cutting arm can thus be lifted or lowered in any horizontally swivelled position.

When cutting profiles by means of partial cut cutting machines having arranged on the free end of the cutting arm cutting heads rotatably supported for rotation in transverse relation to the longitudinal axis of the cutting arm, the advancing direction is most frequently selected in direction of the axis of the rotational movement of the cutting heads. After having attained the nominal profile, the cutting arm is lifted or lowered for the so-called preselected depth of cut, whereupon advancing movement is performed in the opposite direction and again in substantial horizontal direction. It is on account of the construction of such cutting machines that there remains centrally between both cutting heads arranged on the free end of the cutting arm a rib when lifting or lowering the cutting arm for achieving the new preselected depth of cut. In the following, this rib must be broken away when swivelling the cutting arm in a substantially horizontal direction. In dependence on the nature of the rock and on the construction of the machine, this rib may be too big for being broken away without special measures by merely swivelling the cutting arm. In these cases, swivelling of the cutting arm in the assumed new position is not easily possible and expensive manual control operations are required for breaking away this rib to be in the position to continue cutting work in the opposite direction.

SUMMARY OF THE INVENTION

The invention now aims at providing a process of the initially mentioned type, in which reversal of the cutting direction is, in particular after having attained the nominal profile, made possible in a simple manner without the risk that the cutting machine is obstructed in its swivelling movement by a remaining rib. In particular, the invention aims at achieving an exact adaptation to the nature of the rock and to provide the possibility to effect, in particular on occasion of reversal of the cutting direction, arbitrarily oriented movements deviating from the cutting direction, noting that the inclination of the deviation from the advancing direction shall freely be selectable. For solving this task, the process according to the invention essentially consists in that the time interval required for actuating one of the both mentioned drive means and/or the volumetric amount of pressurized fluid supplied to each of the drive means is measured and in that, in dependence on the desired preselected depth of cut and after having attained the time interval of actuating one drive means required for the preselected depth of cut or after having attained the volumetric amount for the displacement in direction of the preselected depth of cut, supply of pressurized fluid to said drive means is closed and only the supply of pressurized fluid to the advancing drive means is released. On account of measuring during this process the actual time interval of actuation of a drive means and/or the volumetric amount of pressurized fluid to be supplied or, respectively, supplied to this drive means, a more rapid or slower preselection of depth of cut and, therewith, a steeper or less inclined transition from one line into the next line during the advancing movement can be achieved independent from the respective other drive means. By means of said both parameters, i.e. time interval and/or volumetric amount, the movements of the cutting arm can, in particular on occasion of reversal of the cutting direction at the end of one line, exactly be adapted to the nature of the existing rock, noting that the actual amount of rock to be cut or to be excavated can be better taken in consideration. The use of said parameters, i.e. time interval and/or measured volumetric amount of pressurized fluid, provides also the possibility to effect the required control in a particularly simple manner by means of electric or, respectively, electromagnetic valves.

The process according to the invention can be performed in a particularly simple manner if separate sources of pressurized fluid are at disposal for both directions of movement of a cutting arm. If, however, only one source of pressurized fluid is at disposal, a well suitable adaptation to the nature of the rock can be obtained and the inclination of the diagonally extending partial section of the movement of the cutting arm on occasion of reversal of the cutting direction can in a well suitable manner be approximated if the drive means for achieving the preselected depth of cut is intermittently actuated, thereby selecting the sum of the time intervals of actuation and/or of the actually supplied volumetric amounts in dependence on the selected depth of cut. Such a procedure can, in principle, be performed by means of two sources of pressurized fluid provided for both adjusting directions of the cutting arm, noting that a step-like cut line is generated when continuously operating the drive means for the advancing movement and intermittently supplying pressurized fluid to the second drive means working in direction of the preselected depth of cut. If only one source of pressurized fluid is at disposal for both directions of drive, it is possible to work in these cases in a simple manner such that for a new preselected depth of cut both drive means are alternately and sequentially supplied with pressurized fluid. In these cases, the drive means working in the other direction is stopped when actuating the drive means for working in one direction, so that a stepped advance is performed till the new line.

A continuous movement of the cutting arm in diagonal direction with freely selectable inclination can in any case be obtained if separate sources for both drive means are simultaneously connected with the drive means, noting that the time interval during which the drive means for preselecting the new depth of cut can be used as a measure for the preselected depth of cut. A more exact measure is, of course, the volumetric determination of the volumetric amount of pressurized fluid to be supplied to the drive means for preselecting the depth of cut, noting that, when preselecting a definite volumetric amount, the time interval for supplying this volumetric amount to the drive means for preselecting the depth of cut can be selected within broad limits, which makes the inclination of the diagonally extending cutting area freely adjustable within broad limits.

On account of the process according to the invention making use of simple electronic control circuits, this process can in a particularly advantageous manner be further developed if the power input of the rotation drive means of the cutting head and/or the power input of the swivel drive means operated in advancing direction and/or the rotating speed of the cutting head and/or the swivel speed in advancing direction is measured and the preselected depth of cut is adjusted in dependence on the measured values. In this manner, a correspondingly smaller depth of cut can be preselected in case of harder rock without overloading the bits of the cutting head. Conversely, monitoring the power input or, respectively, the rotation speed allows a more rapid response to particularly fragile rock in which, of course, the preselected depth of cut can again be increased. Analogous conditions exist in connection with soft or tough rock, respectively, noting that in case of tough rock the proportion of cut material relative to material to be crushed must be selected greater and that, therefore, the ratio of the speed of preselection of the depth of cut to the advancing speed must be adjusted correspondingly steeper.

The inventive apparatus for performing the process is substantially characterized in that electrically controllable valves are interconnected into the conduits for pressurized fluid connected to the drive means and in that an electric or, respectively, electronic control device is connected with the valves, noting that the electric or, respectively, electronic control device comprises switches for actuating the electrically controllable valves, said valves being controlled by adjustable timing members and/or by volume measuring devices in the conduits for pressurized fluid and/or by displacement pickups arranged on the adjusting cylinders. Thus, one can do with simple electrically controlled valve, noting that the electric or, respectively, electronic control unit or, respectively, control device must only comprise adjustable timing members and/or evaluating circuits for the measured values provided by a volumetric measuring sensor or by a displacement pickup arranged on the adjusting cylinders of the hydraulic drive means for the preselected depth of cut. The control signals are only utilized for controlling the electrically controllable valves, which results in a particularly simple construction being safe in operation. In an advantageous manner, the electrically controllable valves are in this case designed as change-over valves for alternately pressurizing both drive means.

By means of the apparatus according to the invention, fully automated cutting work covering a nominal profile can reliably be effected in a simple manner, noting that the arrangement is preferably such that the control device for the advancing movement comprises two switches and in that the drive means for preselecting the depth of cut is, after having finished the preselection of depth of cut, lockable till changing over the advancing direction in opposite direction. In this manner, it is made sure, that even after a short interruption of the cutting work no new preselection of depth of cut is effected but cutting work is continued in the immediately previously intended advancing direction till reversal of the cutting direction is initiated. It is only on occasion effecting cutting work in the opposite advancing direction that a new preselection of depth of cut shall be effected. Such an apparatus can, in a simple manner, be combined with a profile control means or a template control means, respectively, which changes over the switches for the advancing drive means into the opposite direction when the nominal profile is attained, noting that after reversal of the advancing direction the second drive means is operable till having attained the preselected depth of cut.

A particularly simple and reliable arrangement for obtaining differing inclinations of the diagonal section of the movement of the cutting arm along the drift face can be obtained if a pump of variable volumetric supply capacity per unit of time is connected with the drive means for preselecting the depth of cut and if the control device is connected via control conduits with the adjusting member for adjusting the supply capacity of the pump.

BRIEF DESCRIPTION OF THE DRAWING

In the following, the invention is further explained with reference to an embodiment schematically shown in the drawing, in which.

DETAILED DESCRIPTION OF THE PREFERRED EMBODIMENT

Figure 1:
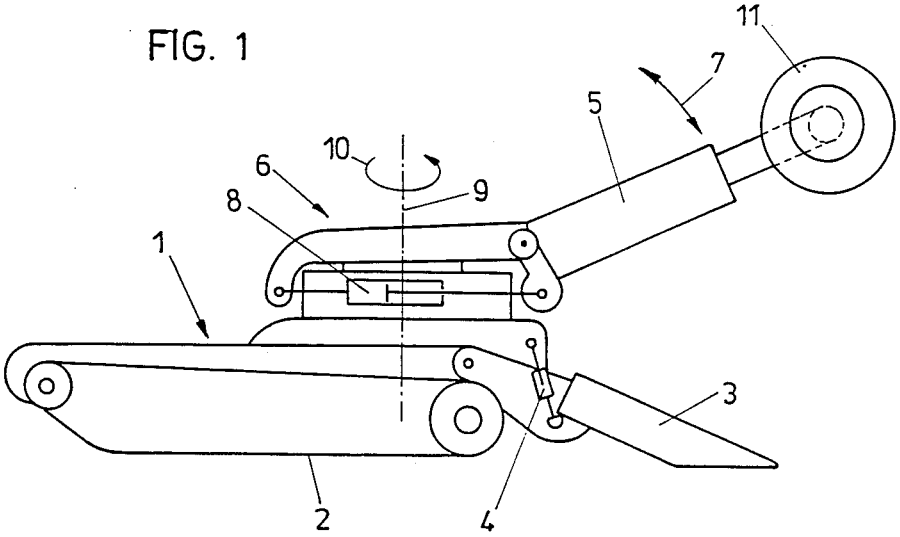
FIG. 1 shows a schematic side elevation of a cutting machine.

In FIG. 1, reference numeral 1 indicates a cutting machine, the caterpillar chassis 2 of which can travel on the drift floor. The cutting machine has, beside a usually provided loading ramp 3 being liftable and lowerable by a hydraulic cylinder-piston-aggregate 4, a cutting arm 5. The cutting arm 5 is swivellable in height direction in direction of the twin arrow 7 by means of hydraulic cylinder-piston-aggregates 8 and is arranged on a traversing gear 6. Furthermore, provision is made for a swivellability in direction of the twin arrow 10 around a substantial vertical axis 9. The swivel drive means for this horizontal swivelling movement is shown in FIG. 2.

The free end of the cutting arm 5 carries rotatably supported cutting heads 11, noting that a rotation drive means for these cutting heads 11 is provided within the interior of the cutting arm 5.

Figure 2:
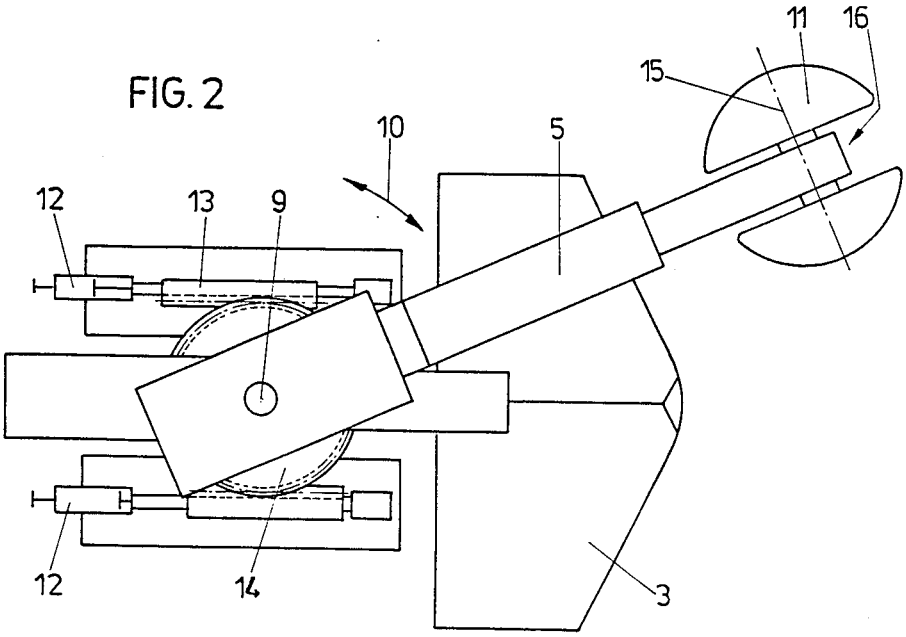
FIG. 2 shows a top plan view of the machine according to FIG. 1 with unimportant details being omitted.

As can be taken from FIG. 2, swivelling in direction of the twin arrow 10, i.e. within a substantially horizontal plane, is effected by hydraulic cylinder-piston-aggregates 12 which are in meshing engagement via tooth racks 13 with a toothed wheel 14 of the traversing gear 6. As can be further taken from the representation according to FIG. 2, an interstice 16 remains between the cutting heads 11 which are rotatably supported for rotation around an axis 15 essentially normally intersecting the longitudinal axis of the cutting arm. Advancing movement of such cutting machines during cutting work is, as a rule, effected by actuating the traversing gear 6 and thus in direction of the axes 15 of rotation. Preselection of the depth of cut is effected by lifting or lowering the cutting arm 5 in direction of the twin arrow 7 shown in FIG. 1, noting that this preselected depth of cut can, on account of the gearing housing and the interstice 16, not always be attained when cutting particularly soft material such as coal, kalium salts or the like. In any case, a rib corresponding to the interstice 16 remains within the rock when lifting or lowering the cutting arm 5 in direction of the twin arrow 7 and this remaining rib must be broken away during the subsequent advancing movement effected by a swivelling movement in direction of the twin arrow 10 or, respectively, by moving the cutting heads 11 in direction of their axis 15 of rotation. This is not easily possible in case of particularly hard rock.

Figure 3:
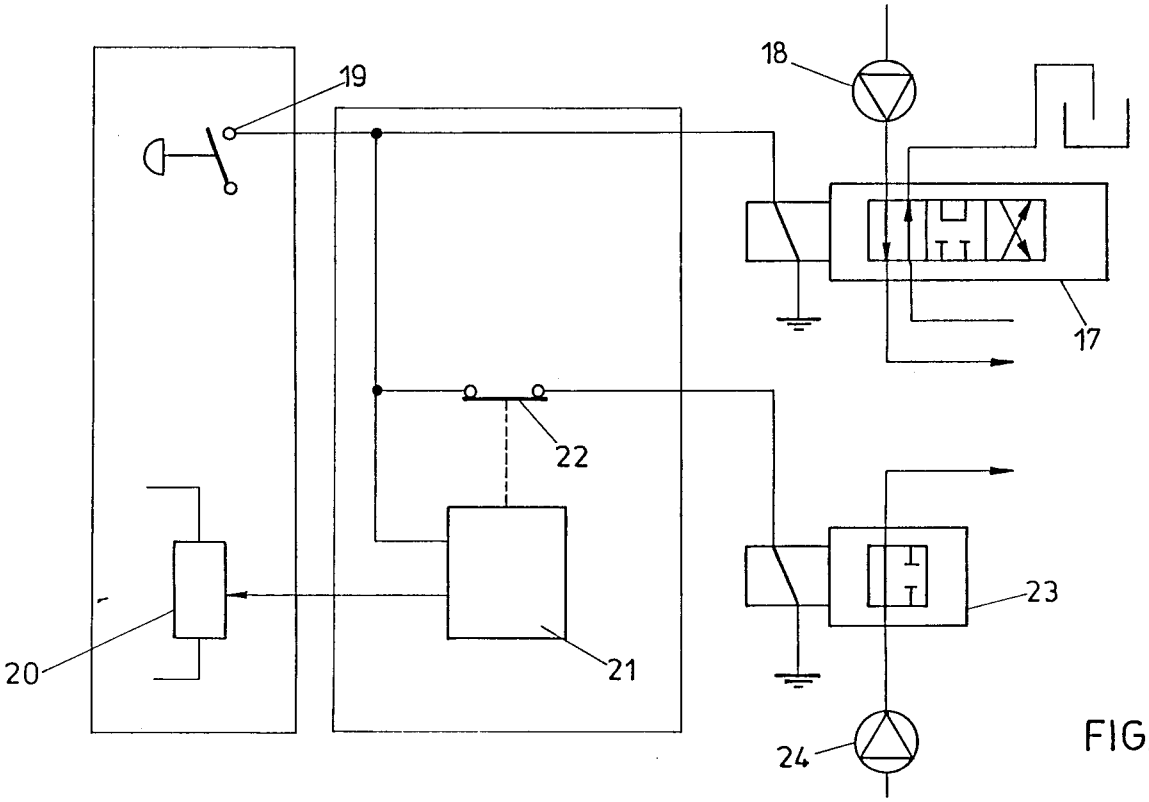
FIG. 3 shows a schematic circuitry of the inventive apparatus for controlling the movement of the cutting arm.

For the purpose of effecting the new preselected depth of cut when changing the cutting direction such that no rib remains between the cutting heads 11, a circuitry is provided, the basic elements of which are shown in FIG. 3 as an example. An electromagentically actuable valve 17 is provided for the traversing gear swivelling the cutting arm in horizontal direction. The hydraulic cylinders are supplied with pressurized fluid via a pump 18 in correspondence with the position of the electromagnetic valve 17. Actuation of this valve is effected by means of a push-button 19 in an operating panel. The operating panel further comprises a potentiometer 20 for preselecting a time constant of a timer 21, which in turn closes a contact 22 in dependence on the adjustment of the timer 21. In dependence of the closing period of the switch 22, an electromagnetic valve 23 is actuated, which supplies pressurized fluid supplied by a pump 24 to the hydraulic drive means for lifting or lowering the cutting arm and thus, as a rule, to the drive means for effecting preselection of depth of cut. In this arrangement, a second pump 24 is provided, which may, for example, in a simple manner be formed by the hydraulic circuit for driving the caterpillars of the chassis of the cutting machine. When preselecting a new depth of cut, the drive means for the caterpillars is not operated, so that the pump 24 can be utilized for an additional purpose.

Figure 4:
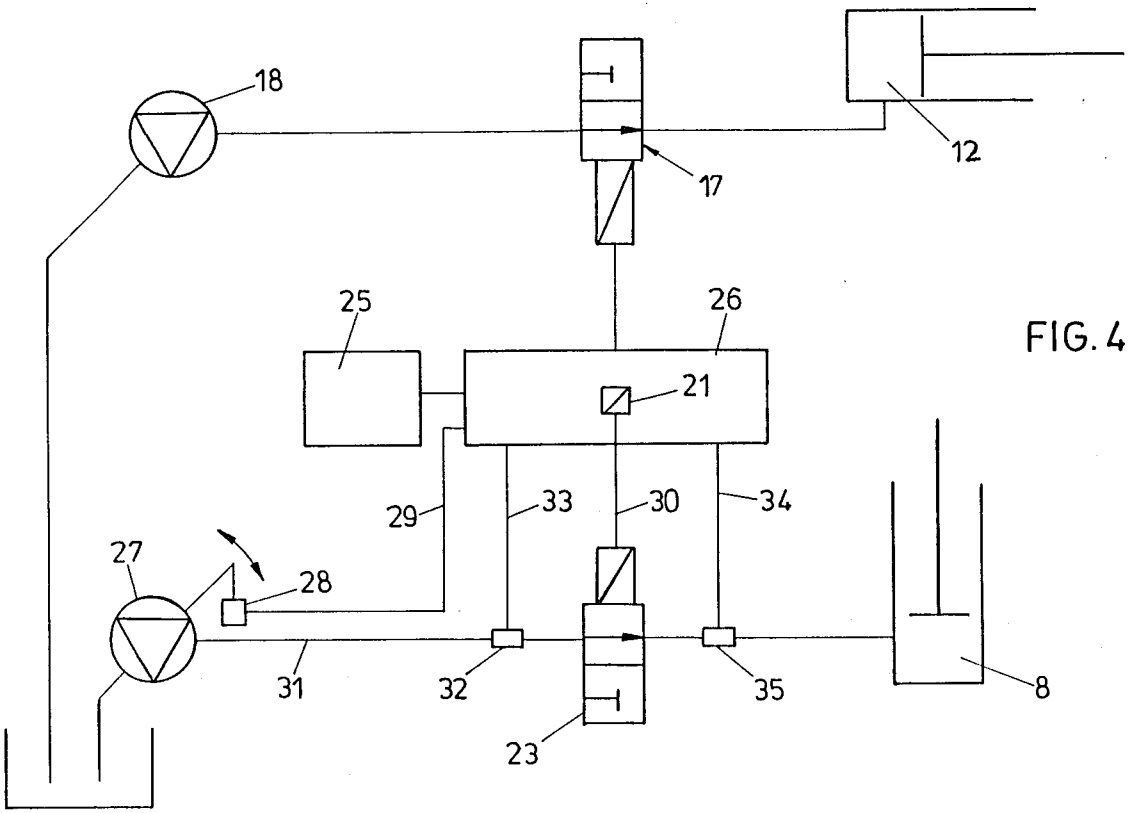
FIG. 4 shows a further modified schematic circuitry and FIG. 5 shows a pattern of the movement of the cutting arm as projected onto the drift face.

A more complete representation of an apparatus for automatically controlling the cutting work can be taken from FIG. 4. The operating unit 25 again contains the push button 19 and the potentiometer 20 for preselecting the time constant, which parts are not shown in FIG. 4. The control device is schematically indicated by reference numeral 26, noting that, for the purpose of better clarity, only the pressure conduits for the hydraulic cylinders 8 and 12, respectively, are shown in FIG. 4. Of course, return conduits are provided and the electromagnetic control valves 23 and 17, respectively, shown in a simplified manner must correspondingly be dimensioned.

There is again provided a pump 18 for horizontally swivelling the cutting arm by means of the cylinders 12 of the horizontal traversing gear. For the second direction of movement and in particular for preselecting the depth of cut, there is provided an adjustable axial piston pump 27, a final control element 28 of which is connected with the control circuit 26 via control conduits 29. In the embodiment shown, the valve 23 is, in dependence on the timer 21 of the control circuit 26, equally connected with the control device 26 via a control conduit 30.

Figure 5:
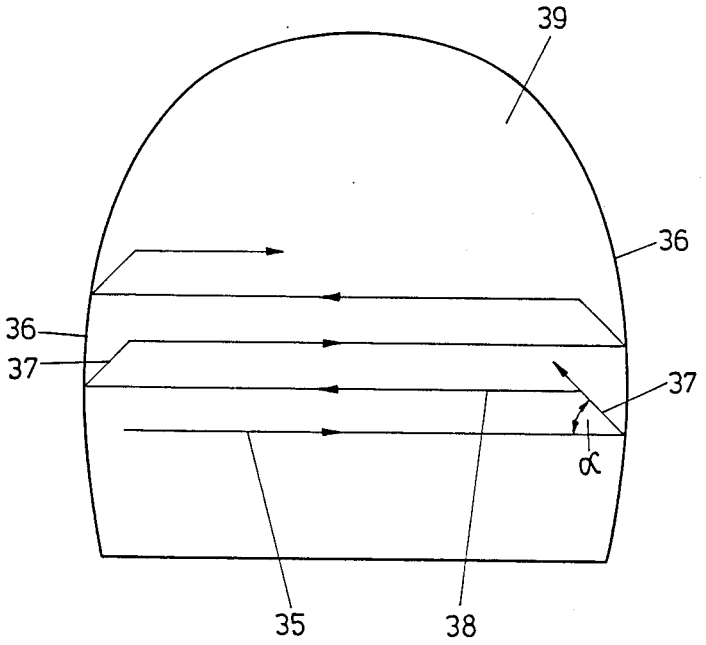

A volume measuring device 32 is interconnected into the conduit 31 for pressurized fluid leading from the pump 27 to the hydraulic cylinder-piston-aggregate 8 and supplies its signals via a signal conduit 33 to the control device 26. In an analogous manner, a signal conduit 34 can be interconnected which comes from a pressure gauge 35 arranged in the conduit behind the electromagnetically actuable valve 23. The electromagnetic valve 23 can now be actuated in dependence on the signals of the volume measuring device 32 or the timer 21, noting that the preselected depth of cut can be derived from these both signals. The steepness or inclination, respectively, of the diagonally extending section of the movement of the cutting arm can be varied by adjusting the final control element 28 of the axial piston pump 27 because in this manner the amount of pressurized fluid supplied per unit of time can be varied. At the drift face, there results now the pattern shown in FIG. 5, noting that the substantially horizontal advancing movement of the cutting head or of the cutting arm, respectively, is indicated by the line 35. When the nominal profile 36 has been attained, reversal of the direction of movement can automatically be effected, noting that the cutting arm is first lifted in the opposite direction along a substantially diagonally extending partial section 37 under free selection of an angle to be preselected. Simultaneously, advancing movement in opposite direction is effected as is indicated by the line 38. The profile to be cut is designated by the reference numeral 39. Deviating from diagonally guiding the cutting arm in the partial sections 37 of the movement of the cutting arm, a step-like transition from the advancing direction represented by the line 35 into the opposite advancing direction represented by the line 38 can be generated at this location. In this case, the mentioned both hydraulic cylinder-piston-aggregates must alternately be actuated. This can also easily be realized by correspondingly actuating the magnetic valves. When continuously actuating the hydraulic cylinders 12 and intermittently actuating the hydraulic cylinder-piston-aggregates 8, there results a trend line comprising steps, which pass over within short time intervals into a diagonal movement corresponding to the section 37 of FIG. 5. Also such a procedure may result in a better adaptation to the nature of the rock and in facilitating the trouble-free and fully automated operation.

The combination of an apparatus according to the invention with an automatic template control provides, in this case, the possibility to reduce the response time when reversing the cutting direction when attaining the nominal profile, which is important because a response time of only 0.1 second may result in a variation of the profile width up to 20 centimeters. Variations up to 20 centimeters of the profile width result, in dependence on the nominal profile in an increase of more than 2 cubic meters of solid material excavated per day in excess, so that a substantial degree of economy is obtained by the automatic control of reversal and by the automated preselection of the next depth of cut.

What is claimed is:

1. A method for controlling the movement of a universally swivellable cutting arm of a partial cut cutting machine of the kind including a first hydraulic drive means for lifting and lowering the cutting arm in order to preselect the depth of cut and a further hydraulic drive means for swiveling the cutting arm transversely relative to the direction of lifting movement and lowering movement, said method comprising: measuring the time interval elapsed for actuating one of said drive means; closing the supply of pressurized fluid to said first hydraulic means in dependence on the desired preselected depth of cut and after having attained the time interval of actuating one drive means required for the preselected depth of cut; and releasing only the supply of pressurized fluid to said further drive means.

2. A method as in claim 1 including intermittently pressuring said first drive means thereby selecting the sum of the time intervals of actuation in dependence on the selected depth of cut.

3. A method as in claim 2 including alternately and in sucession supplying both said drive means with pressure fluid so as to obtain a new preselected depth of cut.

4. A method as in claim 1 wherein separate sources of pressurized fluid for both said drive means are simultaneously connected with both said drive means.

5. A process as in claim 1 including measuring the power input of the rotation drive means of a cutting head and adjusting the preselected depth of cut in dependence on the measured value.

6. In a partial cut cutting machine having a universally swivellable cutting arm, a first hydraulic drive means for lifting and lowering the cutting arm in order to preselect the depth of cut and a further hydraulic drive means for swiveling the cutting arm transversely relative to the direction of lifting and lowering movement: a control system for controlling the movement of the arm, said control system comprising a means for measuring the time interval elapsed for actuating one of said drive means; means for closing the supply of pressure fluid to said first drive means in dependence on the desired preselected depth of cut and after having attained the time interval of actuating one drive means required for the preselected depth of cut; and means for releasing only the supply of pressure fluid to said further drive means.

7. Apparatus as in claim 6 including an electrically controllable valve in a pressure fluid conduit connected to each drive means and an electric control device connected with said valves, said control device including switches for actuating said valves and an adjustable timing member for controlling said valves.

8. Apparatus as in claim 7 wherein the electrically controllable valves are change-over valves for alternately pressuring both drive means.

9. Apparatus as in claim 7 wherein the control device comprises switches and wherein said first drive means is, after having finished the preselection of depth of cut lockable till changing over the advancing direction in opposite direction.

10. Apparatus as in claim 7 wherein the control device is combined with a profile control means which changes over the switches for the advancing drive means into the opposite direction when a normal cutting profile is attained, and wherein after reversal of the advancing direction the first drive means is operable till having attained the preselected depth of cut.

11. Apparatus in claim 7 including a pump of variable volumetric supply capacity per unit of time connected with the first drive means and wherein the control device is connected via control conduits with an adjusting member for adjusting the supply capacity of the pump.

12. A method for controlling the movement of a universally swivellable cutting arm of a partial cut cutting machine of the kind including a first hydraulic drive means for lifting and lowering the cutting arm in order to preselect the depth of cut and a further hydraulic drive means for swiveling the cutting arm transversely relative to the direction of lifting movement and lowering movement, said method comprising: measuring the volumetric amount of pressurized fluid supplied to each of the drive means; closing the supply of pressurized fluid to said first drive means in dependence on the desired preselected depth of cut and after having attained the volumetric amount of the displacement in direction of the preselected depth of cut; and releasing only the supply of pressurized fluid to said further drive means.

13. In a partial cut cutting machine having a universally swivellable cutting arm, a first hydraulic drive means for lifting and lowering the cutting arm in order to preselect the depth of cut and a further hydraulic drive means for swivelling the cutting arm transversely relative to the direction of lifting and lowering movement: a control system for controlling the movement of the arm, said control system comprising a means for measuring the volumetric amount of pressurized fluid supplied to each of said drive means; means for closing the supply of pressure fluid to said first drive means in dependence on the desired preselected depth of cut and after having attained the volumetric amount for the displacement in the direction of the preselected depth of cut; and means for releasing only the supply of pressure fluid to said further drive means.

* * * * *